United States Patent [19]

Kanamori et al.

[11] Patent Number: 4,822,507

[45] **Date of Patent: * Apr. 18, 1989**

[54] LUBRICATING OIL COMPOSITION SERVING AS SLIDING SURFACE OIL AND METAL WORKING OIL, AND METHOD OF LUBRICATING WORKING MACHINERY USING SAID OIL COMPOSITION

[75] Inventors: Hideo Kanamori; Katsumi Hashimoto, both of Ichihara, Japan

[73] Assignee: Idemitsu Kosan Company Limited, Tokyo, Japan

[ * ] Notice: The portion of the term of this patent subsequent to Apr. 26, 2005 has been disclaimed.

[21] Appl. No.: 105,488

[22] Filed: Sep. 30, 1987

Related U.S. Application Data

[63] Continuation of Ser. No. 35,203, Apr. 6, 1987, abandoned, which is a continuation of Ser. No. 805,274, Dec. 5, 1985, abandoned.

[30] Foreign Application Priority Data

Dec. 14, 1984 [JP] Japan ..... 59-262920

[51] Int. Cl.[4] ..... C10M 173/00

[52] U.S. Cl. ..... 252/49.5; 252/12; 252/32.7 R; 252/45; 252/49.8; 252/51.5 A; 408/56; 409/135; 409/136; 29/DIG. 72; 29/DIG. 74; 29/DIG. 87

[58] Field of Search ..... 252/49.5, 51.5 A; 408/56; 409/135, 136; 29/DIG. 72, DIG. 74, DIG. 87

[56] References Cited

U.S. PATENT DOCUMENTS

| | | | |
|---|---|---|---|
| 4,098,585 | 7/1978 | Vartanian et al. | 252/51.5 A |
| 4,185,485 | 1/1980 | Schick et al. | 252/51.5 A |
| 4,239,635 | 12/1980 | Rieder | 252/51.5 A |
| 4,259,206 | 3/1981 | Pictrowski et al. | 252/51.5 A |
| 4,273,664 | 6/1981 | Brandolese | 252/51.5 A |
| 4,280,915 | 7/1981 | Kercheville | 252/51.5 A |
| 4,283,293 | 8/1981 | Schick et al. | 252/51.5 A |
| 4,293,432 | 10/1981 | Papdy et al. | 252/51.5 A |
| 4,344,861 | 8/1982 | Levy | 252/51.5 A |
| 4,448,703 | 5/1984 | Forsberg | 252/51.5 A |

*Primary Examiner*—William R. Dixon, Jr.
*Assistant Examiner*—Ellen McAvoy
*Attorney, Agent, or Firm*—Frishauf, Holtz, Goodman & Woodward

[57] ABSTRACT

A method of lubricating a metal working machine which has (i) at least one sliding machine surface requiring lubication and (ii) a metal working section wherein metal is worked in contact with a metal working fluid, said method comprises applying a lubricating oil composition to said at least one sliding surface and using as said metal working fluid an aqueous working fluid composition comprising said lubricating oil composition diluted with water, said lubricating composition comprising;

(A) 5 to 88% by weight of at least one oil selected from the group consisting of a mineral oil and a synthetic oil, (B) 2 to 50% by weight of a reaction product of a long chain dibasic acid having 14 to 28 carbon atoms and an alkanolamine, (C) 5 to 30% by weight of at least one extreme pressure additive selected from the group consisting of sulfurized fat and oil, a phosphate, a phosphite, and an amine salt of phosphate or phosphite (D) 5 to 30% by weight of an emulsifying agent selected from the group consisting of an anionic surface active agent, a cationic surface active agent, a nonionic surface active agent and a phosphorus-containing surface active agent.

The invention also provides the lubricating oil composition specified hereinbefore.

11 Claims, No Drawings

LUBRICATING OIL COMPOSITION SERVING AS SLIDING SURFACE OIL AND METAL WORKING OIL, AND METHOD OF LUBRICATING WORKING MACHINERY USING SAID OIL COMPOSITION

This application is a continuation, of application Ser. No. 035,203, filed Apr. 6, 1987, which is a continuation of Ser. No. 805,274 filed Dec. 5, 1985, both now abandoned.

BACKGROUND OF THE INVENTION

The present invention relates to a lubricating oil composition serving as a sliding surface oil and a metal working oil, and a method of lubricating working machinery using the lubricating oil composition.

A variety of lubricating oils having different characteristics are used in working machinery depending on the application part and the purpose of use. When, however, these lubricating oils intermingle with each other, there is a danger of reduction in their lubricating characteristics and occurrence of a fatal problem. Thus such intermingling is absolutely necessary to avoid.

In many working machines, particularly a transfer machine, however, a sliding surface oil often intermingles with a metal working oil such as a cutting oil and a grinding oil. In this case, if the metal working oil is of the aqueous emulsion type, the following problems arise.

(1) The metal working oil loses its uniformity in lubricating properties. For this reason, its metal working performance varies and it becomes impossible to accomplish high accuracy metal working.

(2) Decomposition is accelerated, and the service life of the metal working liquid is seriously reduced.

It has therefore been desired to overcome the above problems. As a result of extensive investigations, it has been found that a lubricating oil composition having a specified formulation can serve as a sliding surface oil, that is, an oil for lubricating a sliding surface and also as a metal working oil.

SUMMARY OF THE INVENTION

An object of the present invention is to provide a lubricating oil composition which serves as a sliding oil and a metal working oil.

Another object of the present invention is to provide a method of lubricating working machinery using the above lubricating oil composition.

It has been found that the above objects can be attained by using a lubricating oil composition having a specified formulation, i.e., containing effective components of both the sliding surface oil and metal working oil.

The present invention, in one aspect, relates to a lubricating oil composition serving as a sliding oil and a metal working oil which comprises;

(A) 5 to 88% by weight of at least one oil selected from the group consisting of a mineral oil and a synthetic oil, (B) 2 to 50% by weight of a reaction product of a long chain dibasic acid and alkanolamine, (C) 5 to 30% by weight of an extreme pressure additive and (D) 5 to 30% by weight of an emulsifying agent.

In another aspect, the present invention relates to a method of lubricating a working machine which comprises applying the above lubricating oil composition to the sliding surface of the working machine and applying a dilution of the lubricating oil composition to a metal working section of the working machine.

DETAILED DESCRIPTION OF THE INVENTION

Component (A) of the lubricating oil composition of the present invention is at least one oil selected from the group consisting of a mineral oil and a synthetic oil. This component (A) is a base material of the lubricating oil composition. These are no special limitations to these mineral and synthetic oils. It is, however, preferred to use a mineral oil and/or a synthetic oil having a viscosity of 5 to 55 centistokes (cst) as determined at 40° C. Typical examples of the mineral oil are a lubricating oil fraction of naphthenic, intermediate and paraffinic mineral oils, and a high aromatic component as obtained by decomposition of such mineral oils. Typical examples of the synthetic oil are long chain alkylbenzene, branched alkylbenzene, polyolefin such as polybutene, alkylnaphthalene, ester oil, and polyglycol. Of these compounds, a naphthenic mineral oil is preferred. The above oils can be used alone or in combination with each other.

The amount of the mineral oil and/or a synthetic oil compounded is 5 to 88% by weight, preferably 10 to 80% by weight based on the total weight of the composition. If the amount of the mineral oil and/or a synthetic oil compounded is less than 5% by weight, it is difficult to control the viscosity of the composition and when the composition is used in a metal working part, corrosion is liable to occur.

Component (B) of the lubricating oil composition of the present invention is a reaction product of a long chain dibasic acid and alkanolamine.

Dibasic acids which can be used in the present invention include compounds represented by the formula:

$$HOOC(CH_2)_nCOOH$$

(wherein n is 12 to 26), and having 14 to 28 carbon atoms. Typical examples of these dibasic acids are shown below.

$$HOOC.(CH_2)_5.\underset{\underset{C_2H_5}{|}}{CH}(CH_2)_6COOH,\quad HOOC.(CH_2)_5.\underset{\underset{C_2H_5}{|}}{CH}(CH_2)_{10}COOH,$$

$$HOOC.(CH_2)_6.CH{=}CH(CH_2)_6COOH,\quad HOOC.(CH_2)_6.CH{=}CH(CH_2)_2CH{=}CH.(CH_2)_6COOH,$$

$$HOOC.(CH_2)_5.\underset{\underset{CH{=}CH_2}{|}}{CH}(CH_2)_6COOH,\quad HOOC.(CH_2)_5.\underset{\underset{CH{=}CH_2}{|}}{CH}(CH_2)_2CH{=}CH(CH_2)_6COOH,$$

-continued $$HOOC.(CH_2)_6-C(CH_3)=CH-(CH_2)_2-CH=C(CH_3)-(CH_2)_6-COOH$$

Alkanolamines which are reacted with the above long chain dibasic acids includes amines in which the alkanol group has 2 to 4 carbon atoms. Typical examples of the alkanolamine are monoethanolamine, diethanolamine, triethanolamine, monopropanolamine, dipropanolamine, tripropanolamine, monobutanolamine, dibutanolamine, tributanolamine, monomethyldiethanolamine, monomethyldipropanolamine, monomethyldibutanolamine, and monoethyldiethanolamine.

The reaction product of the long chain dibasic acid and alkanolamine can be prepared by mixing a long chain dibasic acid and alkanolamine, the mole ratio of the alkanolamine to the long chain dibasic acid being 0.5:1 to 5:1, and then reacting them at a temperature of room temperature to 200° C. for 5 to 100 minutes.

In the present invention, the reaction product of the long chain dibasic acid and alkanolamine is used as the second component. The amount of the reaction product of the long chain dibasic acid and alkanolamine compounded is 2 to 50% by weight, preferably 5 to 30% by weight based on the total weight of the composition. If the amount of the second component compounded is less than 2% by weight, when the composition is used as a metal working oil, undesirable problems arise in that the metal is readily rusted and the metal working performance drops. On the other hand, even if the second component is added in excess of 50% by weight, any further effect cannot be obtained and thus it is not desirable from an economic standpoint.

As the component (C) of the lubricating oil composition of the present invention, an extreme pressure additive is used. There are no special limitations to the extreme pressure additive. Typical examples of the extreme pressure additive are sulfurized fats and oils such as sulfurized lard, sulfurized sperm oil, and sulfurized castor oil; phosphates such as tributyl phosphate, tricresyl phosphate, trioctyl phosphate, triphenyl phosphate, lauryl acid phosphate, and oleyl acid phosphate; phosphites such as di-lauryl hydrogen phosphite and di-oleyl hydrogen phosphite; and amine salts of phosphates or phosphites such as beef tallow amine salt of octyl acid phosphate or di-lauryl hydrogen phosphite, and oleylamine salt of oleyl acid phosphate or di-oleyl hydrogen phosphite. These compounds can be used alone or in combination with each other.

The amount of the extreme pressure additive compounded is 5 to 30% by weight, preferably 5 to 20% by weight based on the total weight of the composition. When the extreme pressure additive is compounded in an amount less than 5% by weight, it is preferred to use a phosphorus-containing surface active agent as an emulsifying agent. This surface active agent imparts the lubricating oil composition with the following properties. One is that the composition when used as a sliding surface oil prevents the occurrence of stick slip, and the other is that the composition when applied to a metal working section in a dilution form prevents a reduction in cutting properties. On the other hand, if the amount of the extreme pressure additive compounded is in excess of 30% by weight, undesirable problems arise in that oil stains are readily formed when the composition is used as a sliding surface oil and in that when the composition is used as a metal working oil, the metal is easily rusted and decomposition of the composition is accelerated.

As the component (D) of the oil lubricating composition of the present invention, an emulsifying agent is used. There are no special limitations to the emulsifying agent. Typical examples of the emulsifying agent are anionic surface active agents such as fatty acid soap, naphthenic acid soap and sulfate; cationic surface active agents such as long chain primary amine salts, and alkyltrimethyl ammonium salts; and nonionic surface active agents such as polyoxyethylene alkyl ether, polyoxyethylene alkylphenyl ether, polyoxyethylene alkyl ester, and polyoxyethylene alkylphenyl ester. In addition, phosphorus-containing surface active agents such as dipolyoxyethylene alkyl ether phosphate, dipolyoxyethylene alkylphenyl ether phosphate, tripolyoxyethylene alkyl ether phosphate, and tripolyoxyethylene alkylphenyl ether phosphate can be used.

The amount of the emulsifying agent compounded is 5 to 30% by weight, preferably 10 to 20% by weight based on the total weight of the composition. If the amount of the emulsifying agent compounded is less than 5% by weight, the emulsion stability of the metal working solution is poor, and so it cannot be used in metal working. On the other hand, if the amount of the emulsifying agent used is in excess of 30% by weight, stick slip is undesirably produced when the composition is used as a sliding surface oil.

If necessary, an antioxidant, a metal deactivator, a defoaming agent, a disinfectant, and so forth can be added to the lubricating oil composition of the present invention.

The oil lubricating composition of the present invention is prepared by mixing the above components.

When the oil lubricating composition of the present invention is used as a sliding surface oil, it is usually used as such, and when used as a metal working oil, it is preferably diluted with water to 3 to 100 times, preferably 20 to 50 times.

In accordance with the lubricating method of the present invention, the above lubricating oil composition is applied to a sliding surface of a working machine, and a dilution of the lubricating oil composition is applied to a metal working section of the working machine. The working machine to which the lubricating oil composition of the present invention is applied is a machine equipped with a sliding surface and a metal working section. A typical example of such working machines is a transfer machine in which the sliding surface oil readily intermingles with the metal working oil because of its structure.

In the lubricating method of the present invention, the lubricating oil composition is applied to the sliding surface of a working machine, and a dilution of the oil lubricating composition is applied to the metal working section of the working machine. When the lubricating oil composition is used in metal working such as cutting and grinding, it is diluted with water to about 3 to 100 times and applied in an aqueous diluted form. In lubricating a transfer machine, the lubricating oil composition is applied to a sliding surface and a dilution of the composition is used in metal working.

In the present invention, a single oil composition acts as the sliding surface oil and also as a metal working oil.

That is, the lubricating oil composition of the present invention does not produce oil stains when used as the sliding surface oil and when used as the metal working oil, permits high accuracy metal working and prevents the formation of e.g., rust.

Moreover, since the lubricating oil composition of the present invention acts as a sliding surface oil and a metal working oil, even if the sliding surface oil intermingles with metal working oil, problems encountered in the conventional lubrication, such as reduction in metal working performance of the working machine and a serious decrease in the service life of the metal working oil, do not occur. Thus the lubrciating oil composition and the lubricating method of the present invention are especially effective when applied to a machine of the type that the metal working oil is used in a recycle system.

Although the lubricating oil composition of the present invention is of the emulsion type, it exhibits good lubricating characteristics even when used as a sliding surface oil.

Accordingly the lubricating oil composition and the lubricating method of the present invention are useful for lubrication of working machinery, particularly a transfer machine.

The present invention is described in greater detail with reference to the following examples.

EXAMPLES 1 TO 6, AND COMPARATIVE EXAMPLES 1 TO 6

Lubricating oil compositions having the formulations shown in Table 1 were prepared.

Each lubricating oil composition was measured for performance as a sliding surface oil and performance as a metal working oil by the testing methods described below. The results are shown in Table 1. (1) Sliding Surface Test The coefficient of dynamic friction ($\mu$) and formation of stick slip were measured by the Idemitsu method (a modification of ASTM D 2877-70, which is carried out under conditions as described below (see Idemitsu TRIBO Review, Vol. 1; No. 2, p. 141–144)).

Measuring Conditions

Surface pressure: 0.54 kg/cm$^2$
Sliding speed: 12 mm/min and 160 mm/min
Material of sliding surface:

Bed made by polishing steel plate, steel S45C of JIS G 4051

Saddle of plate, (metal FC-20 of JIS G5501, with a scraped surface.

(2) Oil Stain Test

Distilled water was added to the lubricating oil composition in a proportion of 5% by weight based on the weight of the composition and then stirred to prepare an emulsion. This emulsion was placed between two FC-20 plates (30×70×10 mm) and allowed to stand for 5 days at a temperature of 60° C. After separation of the two plates, the formation of oil stains was examined.

(3) Copper Plate Corrosion Test

Measured according to JIS K2513, wherein the test carried out at a temperature of 50° C. for 3 hours.

(4) Cutting Test

A cemented carbide tip (material P20 of JIS B4104, was mounted on a lathe and cut, and cutting tool wear was measured. The sample was a 30% emulsion. Cutting conditions were as follwos:

Cutting speed: 100 m/min
Feed: 0.1 mm/rev.
Depth of cut: 2 mm
Distance of cut: 4,800 m.

(5) Initial Emulsion Stability Test

In a 100-milliliter measuring cylinder were placed 97 milliliters of water, and 3 milliliters of the lubricating oil composition sample were dropped therein. After 30 minutes, it was examined to determine if the oil sample floated or separated on the top of water (initial emulsifying property). When the oil sample was dispersed or dissolved in water, the volume of the oil sample dispersed or dissolved was measured (solubility). For the lubricating oil composition to be used in the present invention it is required that it should not be separated as the top layer and the volume of the oil composition dispersed or dissolved is at least 30 milliliters.

(6) Rust Prevention Test

The cutting test was conducted using oil emulsions of varied concentrations. After 7 days, it was examined to determine if the powder of cut material was rusted. This cutting test was conducted by cutting a material, (material FCD-40 of JIS G5502, on a drilling press by the use of an endmill tool.

COMPARATIVE EXAMPLE 7

A lubricating oil composition on the market was tested in the same manner as in Example 1. The results are shown in Table 1.

TABLE 1

| | | Example | | | | | |
|---|---|---|---|---|---|---|---|
| | | 1 | 2 | 3 | 4 | 5 | 6 |
| Composition (% by weight) | | | | | | | |
| Component (A) | 120 Machine Oil*1 | 72.8 | 64.8 | 66.8 | 66.8 | — | — |
| | Synthetic Oil*2 | — | — | — | — | 49.8 | 64.8 |
| Component (B) | Reaction Product I*3 | 10 | 15 | — | 15 | 20 | — |
| | Reaction Product II*4 | — | — | 15 | — | — | 5 |
| Component (C) | Sulfurized Lard | 5 | 10 | — | 2 | 20 | — |
| | Amine Salt of Phosphate | 2 | — | 8 | 6 | — | 10 |
| Component (D) | Mixed Emulsifying Agent*5 | 10 | 10 | 10 | 10 | 10 | 20 |
| Benzotriazole | | 0.2 | 0.2 | 0.2 | 0.2 | 0.2 | 0.2 |
| Characteristics | | | | | | | |
| Sliding Surface Test | 12 mm/min | 0.14 | 0.15 | 0.13 | 0.14 | 0.12 | 0.15 |
| | 160 mm/min | 0.12 | 0.13 | 0.11 | 0.12 | 0.11 | 0.13 |
| Oil Stain Test | | No stain | No stain | Slightly stained | Slightly stained | Slightly stained | Slightly stained |
| Copper Plate Corrosion Test*6 | | 1a | 1b | 1b | 1a | 1b | 1a |
| Cutting Test Frank Wear ($\mu$m) | | 35 | 40 | 78 | 72 | 34 | 39 |
| Initial Emulsion Stability Test | | 60 ml | 60 ml | 60 ml | 60 ml | 70 ml | 70 ml |
| Rust Prevention Test | | | | | | | |

TABLE 1-continued

| | | | | | | | |
|---|---|---|---|---|---|---|---|
| 20 time-diluted | No rust | No rust | No rust | No rust | No rust | No rust | |
| 30 time-diluted | No rust | No rust | No rust | No rust | No rust | No rust | |
| 50 time-diluted | No rust | No rust | No rust | No rust | No rust | No rust | |

| | | Comparative Example | | | | | | |
|---|---|---|---|---|---|---|---|---|
| | | 1 | 2 | 3 | 4 | 5 | 6 | 7 |
| Composition (% by weight) | | | | | | | | |
| Component (A) | 120 Machine Oil*1 | 79.8 | 74.8 | 74.8 | 19.8 | 34.8 | 44.8 | (Oil on the market) |
| | Synthetic Oil*2 | — | — | — | — | — | — | |
| Component (B) | Reaction Product I*3 | — | 15 | 15 | 60 | 15 | 10 | |
| | Reaction Product II*4 | — | — | — | — | — | — | |
| Component (C) | Sulfurized Lard | — | — | — | — | — | — | |
| | Amine Salt of Phosphate | 10 | — | 10 | 10 | 40 | 10 | |
| Component (D) | Mixed Emulsifying Agent*5 | 10 | 10 | — | 10 | 10 | 35 | |
| Benzotriazole | | 0.2 | 0.2 | 0.2 | 0.2 | 0.2 | 0.2 | |
| Characteristics | | | | | | | | |
| Sliding Surface Test | 12 mm/min | 0.14 | Stick slip | Impossible | 0.15 | 0.14 | 0.18 | 0.18 |
| | 160 mm/min | 0.12 | Stick slip | (Separation) | Stick slip | 0.12 | Stick slip | Stick slip |
| Oil Stain Test | | Extremely stained | No stain | No stain | No stain | Extremely stained | No stain | Extremely stained |
| Copper Plate Corrosion Test*6 | | 1b | 1a | 1a | 1a | 1b | 1b | 1a |
| Cutting Test Frank Wear (mg) | | 70 | 73 | Impossible | 60 | 38 | 65 | 79 |
| Initial Emulsion Stability Test | | 30 ml | 70 ml | 10 ml | 70 ml | 50 ml | 70 ml | 35 ml |
| Rust Prevention Test | | | | | | | | |
| 20 time-diluted | | Rusted | No rust | No rust | No rust | No rust | No rust | No rust |
| 30 time-diluted | | Rusted | No rust | No rust | No rust | Rusted | No rust | Rusted |
| 50 time-diluted | | Rusted | No rust | No rust | No rust | Rusted | Rusted | Rusted |

Note
*1Flash point: 190° C.
Kinematic Viscosity at 40° C.: 55 cst
*2α-Olefin oligomer (viscosity at 100° C.: 8 cst)
*3Reaction product of $HOOC(CH_2)_5.\underset{\underset{C_2H_5}{|}}{C}H(CH_2)_{10}COOH$ and diethanolamine (1:2 by mole)
*4Reaction product of $HOOC(CH_2)_5.\underset{\underset{C_2H_5}{|}}{C}H(CH_2)_6COOH$ and diethanolamine (1:3 by mole)
*5Mixture of nearly equal amounts by weight of polyoxyethylene nonylphenyl ether (n = 2) and polyoxyethylene nonylphenyl ether (n = 4) (n: average number of moles of added ethylene oxide)
*6Indicating a degree of corrosion.
1a . . . Almost no corrosion
The degree of corrosion increases in the order of 1b, 2a, 2b, 3a, 3b, 4a, . . . (that is, 4a indicates a greater degree of corrosion than does 3b).

What is claimed is:

1. A method of lubricating a metal working machine which has (i) at least one sliding machine surface requiring lubrication and (ii) a metal working section wherein metal is worked in contact with a metal working fluid, and, wherein the operation of said machine causes the sliding machine surface lubrication to mix with the metal working liquid, said method comprising applying a lubricating oil composition to said at least one sliding surface and using as said metal working fluid an aqueous working fluid composition comprising said lubricating oil composition diluted with water, the ratio of water to said lubricating oil composition being at least 3 to 1, said lubricating oil composition comprising:

(A) 5 to 88% by weight of at least one oil selected from the group consisting of a mineral oil and synthetic oil, (B) 2 to 50% by weight of a reaction product of a long chain dibasic acid of the formula $$HOOC.(CH_2)_5.\underset{\underset{C_2H_5}{|}}{C}H(CH_2)_6COOH,$$

$$HOOC.(CH_2)_5.\underset{\underset{C_2H_5}{|}}{C}H(CH_2)_{10}COOH,$$

$$HOOC.(CH_2)_6.CH{=}CH(CH_2)_6COOH,$$
$$HOOC.(CH_2)_6.CH{=}CH(CH_2)_2CH{=}CH.(CH_2)_6COOH,$$

-continued $$HOOC.(CH_2)_5.\underset{\underset{CH{=}CH_2}{|}}{C}H(CH_2)_6COOH,$$

$$HOOC.(CH_2)_5.\underset{\underset{CH{=}CH_2}{|}}{C}H(CH_2)_2CH{=}CH(CH_2)_6COOH, \text{ or}$$

$$HOOC.(CH_2)_6{-}C(CH_3){=}CH{-}(CH_2)_2{-}CH{=}C(CH_3){-}(CH_2)_6{-}COOH$$

and a $C_2$–$C_4$ alkanolamine present in a molar ratio of 1:0.5 to 5, (C) 5 to 30% by weight of at least one extreme pressure additive selected from the group consisting of sulfurized fat and oil, a phosphate, a phosphite, and an amine salt of phosphate or phosphite, and (D) 5 to 30% by weight of an emulsifying agent selected from the group consisting of an anionic surface active agent, a cationic surface active agent, a nonionic surface active agent and a phosphorus-containing surface active agent.

2. The method of claim 1, wherein the Component (A) is a naphthenic mineral oil.

3. The method of claim 1, wherein the Component (A) is a oil having a viscosity of 5 to 55 centistokes as determined at 40° C.

4. The method of claim 1, wherein the Component (C) is a sulfurized fat and oil, a phosphate or an amine salt of a phosphate.

5. The method of claim 1, wherein the Component (A) is an oil having a viscosity of 5 to 55;

the alkanolamine is a compound in which the alkanol group has 2 to 4 carbon atoms;

the Component (C) is a sulfurized fat or oil, a phosphate or an amine salt of a phosphate; and the ratio of water to said lubricating oil composition in said aqueous working fluid composition is at least 3 to 1.

6. The method of claim 5, wherein the Component (A) is a naphthenic mineral oil.

7. The method of claim 1, wherein the ratio of water to said lubricating oil in said aqueous working fluid composition is from 20 to 50 parts water to 1 part said lubricating oil.

8. The method of claim 7, wherein the Component (A) is in an amount of from 10 to 80%, (B) is in an amount of from 5 to 30%, (C) is in an amount of from 5 to 20% and (D) is in an amount of from 10 to 20%.

9. The method of claim 8, wherein the Component (A) is an oil having a viscosity of 5 to 55;

the alkanolamine is a compound in which the alkanol group has 2 to 4 carbon atoms; and the Component (C) is a sulfurized fat or oil, a phosphate or an amine salt of a phosphate.

10. The method of claim 9, wherein the Component (A) is a naphthenic mineral oil.

11. The method of claim 10, wherein said Component (B) is the reaction product of $$HOOC(CH_2)_5\cdot\underset{\underset{C_2H_5}{|}}{CH}(CH_2)_mCOOH$$

with m being 6 or 10, and diethanolamine, the molar ratio of acid to amine being from 1:2 to 1:3; (C) is sulfurized lard; and (D) is a mixture of polyoxyethylene nonylphenyl ether having an average of 2 moles of added ethylene oxide and polyoxyethylene nonylphenyl ether having an average of 4 moles of added ethylene oxide.

* * * * *